US006283303B1

(12) United States Patent
Lane et al.

(10) Patent No.: US 6,283,303 B1
(45) Date of Patent: Sep. 4, 2001

(54) VIBRATING SCREEN SEPARATOR, SEPARATING METHOD, AND CLAMPING DEVICE

(75) Inventors: Jason Wade Lane, Dallas, TX (US); Roger Lane Suter, Edmond, OK (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 09/280,643

(22) Filed: Mar. 29, 1999

(51) Int. Cl.[7] ..... B07B 1/49

(52) U.S. Cl. ..... 209/405; 209/403; 209/409; 209/399; 24/463

(58) Field of Search ..... 209/309, 325, 209/326, 331, 332, 397, 399, 401, 403, 409, 405; 24/455, 463

(56) References Cited

U.S. PATENT DOCUMENTS

| | | | | |
|---|---|---|---|---|
| 3,261,469 | | 7/1966 | Wehner . | |
| 3,666,095 | | 5/1972 | Krynock et al. | 209/326 X |
| 3,977,103 | * | 8/1976 | Strickland | 24/463 X |
| 4,086,640 | * | 4/1978 | Ragle et al. | 209/613 X |
| 4,152,253 | | 5/1979 | Summers | 209/405 X |
| 4,274,953 | | 6/1981 | Jackson | 209/326 |
| 4,350,596 | | 9/1982 | Kennedy, Jr. | 210/708 |
| 4,420,391 | | 12/1983 | Sharki | 209/403 |
| 4,457,839 | | 7/1984 | Bailey | 209/403 X |
| 5,037,536 | | 8/1991 | Koch et al. | 209/325 |
| 5,199,574 | | 4/1993 | Hollyfield, Jr. et al. | 209/315 |
| 5,332,101 | * | 7/1994 | Bakula | 209/403 |
| 5,456,365 | * | 10/1995 | Janssens et al. | 209/403 |

* cited by examiner

*Primary Examiner*—Tuan N. Nguyen
(74) *Attorney, Agent, or Firm*—Haynes and Boone, LLP

(57) ABSTRACT

A clamping device for clamping an object to a structure, the device including a lever arm pivotally mounted relative to the structure, at least one member for urging one end portion of the arm in a direction to pivot the other end portion into engagement with the object, and an actuator supported by the housing and adapted to engage the one end portion of the arm to pivot the other end portion out of the engagement. The device is utilized to clamp a screen to a bed of a separator.

31 Claims, 3 Drawing Sheets

VIBRATING SCREEN SEPARATOR, SEPARATING METHOD, AND CLAMPING DEVICE

BACKGROUND OF THE INVENTION

This invention relates to a vibrating screen separator and, more particularly, to such a separator utilizing a pretensioned screen on a vibrating bed for separating solids of different sizes or for separating solids from a liquid.

A typical screen separator consists of an elongated, box-like, rigid bed, and a screen attached to, and extending across, the bed. The bed is vibrated as the material to be separated is introduced to the screen which retains the relatively large size material and passes the liquid and/or relatively small sized material into the bed. The bed can be vibrated by pneumatic, hydraulic, or rotary vibrators, in a conventional manner.

In these type arrangements, it is difficult to positively clamp the screen to the bed during the separating process, yet permit the screen to be easily removed for cleaning or replacement. For example, rubber bladder systems have been used to clamp the screen, but suffer from excessive wear and are dependent on available air pressure for clamping force. Also, wedge devices, although having certain advantages, suffer from the fact that they use small parts that can be lost, damaged or become out of adjustment. Also, it takes an inordinately long time to replace both of these devices should they fail or wear out.

Therefore, what is needed is a device for clamping a separation screen to a vibrating bed, easily and quickly without the need for air pressure for the clamping force, yet is durable, does not come out of adjustment, and is reliable. Also needed is quick, external access and single component replacement in connection with the clamping devices which eliminate the need for complete screen unit disassembly.

SUMMARY OF THE INVENTION

The present invention, accordingly, is directed to a device for clamping an object, such as a separating screen, to a structure, such as a vibrating bed, according to which a lever arm is provided that is pivotally mounted relative to the structure. At least one member is provided for urging one end portion of the arm in a direction to pivot the other end portion into engagement with the object. An actuator is supported by the housing and adapted to engage the one end portion of the arm to pivot the other end portion out of the engagement.

There are several advantages to the system and method according to an embodiment of the present invention. For example, the clamping device clamps the screen to the bed easily and quickly without the need for air pressure for the clamping force, yet is durable, does not come out of adjustment, and is reliable. Also, quick, external access and single component replacement are provided for the clamping devices which eliminate the need for complete screen unit disassembly.

DETAILED DESCRIPTION OF THE PREFERRED EMBODIMENT

Figure 1:
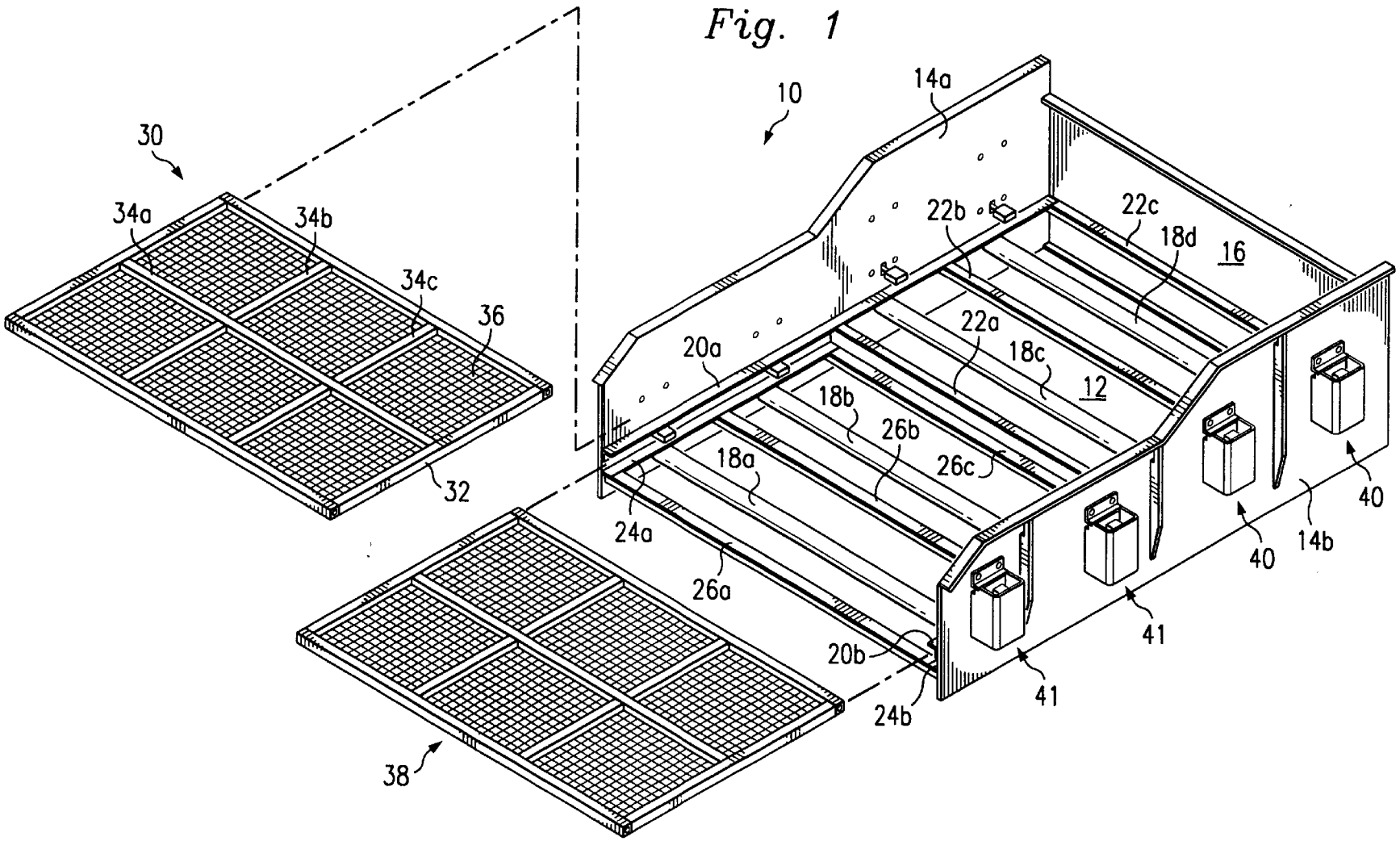
FIG. 1 is an exploded isometric view of a vibrating screen separator according to an embodiment of the present invention.

Referring to FIG. 1 of the drawings, the reference numeral 10 refers, in general, to an open housing, or bed, having a floor, or bottom wall 12, and two side walls 14*a* and 14*b* that are respectively connected to the longitudinal edges of the bottom wall and extend perpendicularly thereto. A rear wall 16 is connected to the rear edge of the bottom wall 12 and to the rear ends of the side walls 14*a* and 14*b*, and also extends perpendicularly to the bottom wall.

Four cross braces 18*a*–18*d* extend between the side walls 14*a* and 14*b* and slightly above the bottom wall 12. The cross braces 18*a*–18*d* are connected to the side walls 14*a* and 14*b* in any known manner and function to add strength and rigidity to the bed 10.

Two angle irons 20*a* and 20*b* are respectively connected to the inner surfaces of the side walls 14*a* and 14*b* in any known manner, and extend for the entire length thereof. Three spaced support bars 22*a*–22*c* extend between the side walls in the rear portion of the bed and are connected to the side walls in any known manner. The upper surfaces of the support bars 22*a*–22*c* extend flush with the upper surfaces of the angle irons 20*a* and 20*b*, with the respective end portions of the support bars being notched to receive the angle irons.

Two angle irons 24*a* and 24*b* also are respectively connected to the inner surfaces of the side walls 14*a* and 14*b* and extend below, and parallel to, the angle irons 22*a* and 22*b*, respectively. The angle irons 24*a* and 24*b* extend from the front ends of the bottom wall 12 to a location approximately midway between the respective ends thereof. Three spaced support bars 26*a*–26*c* extend between the side walls 14*a* and 14*b* in the front portion off the bed 10 and are connected to the side walls 14*a* and 14*b* in any known manner. The upper surfaces of the support bars 26*a*–26*c* extend flush with the upper surfaces of the angle irons 24*a* and 24*b*, and the respective end portions of the support bars are notched to receive the angle irons. The support bars 26*a*–26*c* thus extend below, and parallel to, the support bars 22*a*–22*c*.

Figure 2:
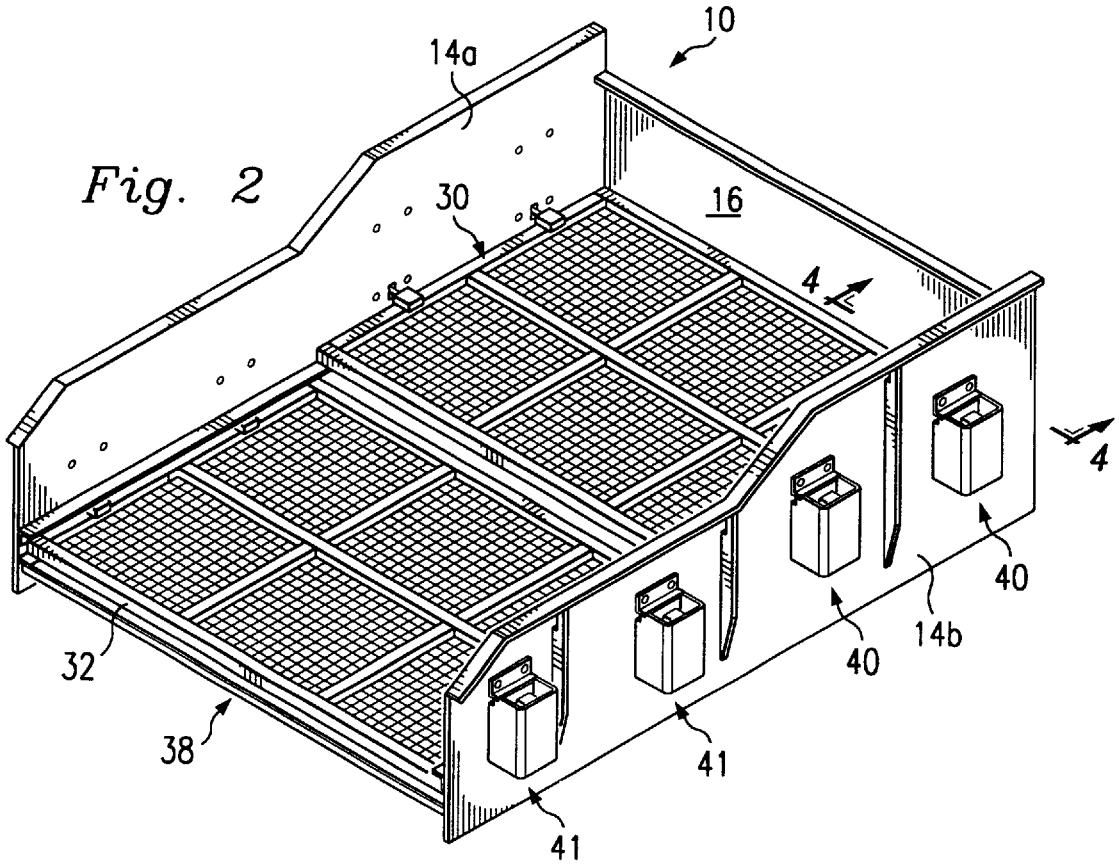
FIG. 2 is a view similar to that of FIG. 1 but depicting the separator in an assembled condition.

As shown in FIGS. 1 and 2, a screen assembly 30 is provided in the rear portion of the bed 10 and rests on the upper surfaces of the upper angle irons 20*a* and 20*b* and the upper support bars 22*a*–22*c*. The screen assembly 30 includes an outer rigid frame 32 (FIG. 1), a longitudinal support strut 34*a*, and two spaced lateral cross-struts 34*b* and 34*c*, all of which support a mesh-like material 36 which is connected to the frame and the struts in a conventional manner. The material 38 is selected so that it passes liquid and very small solid particles and retains larger particles of a certain size. The width of the screen assembly 30 is slightly less that the distance between the inner surfaces of the side walls 14*a* and 14*b* and, in the installed position shown in FIG. 2, the screen assembly extends for approximately one-half the length of the bed with its rear end abutting the inner surface of the rear wall 16.

A screen assembly 38 is provided in the front portion of the bed 10 and rests on the upper surfaces of the lower angle irons 24*a* and 24*b* and the lower support bars 26*a*–26*c*. The screen assembly 38 is identical to the screen assembly 30 and it extend for approximately one-half the length of the bed 10 with its front end extending substantially flush with the front end of the bed 10.

It is understood that the bed 10 is vibrated by pneumatic, hydraulic, or rotary vibrators in a conventional manner as the material to be separated is introduced to the screen and that the screen functions to retain the relatively large size material and passes the liquid and/or relatively small sized material into the bed.

Two spaced clamping devices 40 are mounted to each side wall 14*a* and 14*b* for clamping the screen assembly 30 to the upper surfaces of the angle irons 20*a* and 20*b*, and two spaced clamping devices 41 are also mounted to each side wall for clamping the screen assembly 38 to the upper surfaces of the angle irons 24*a* and 24*b*.

Figure 3:
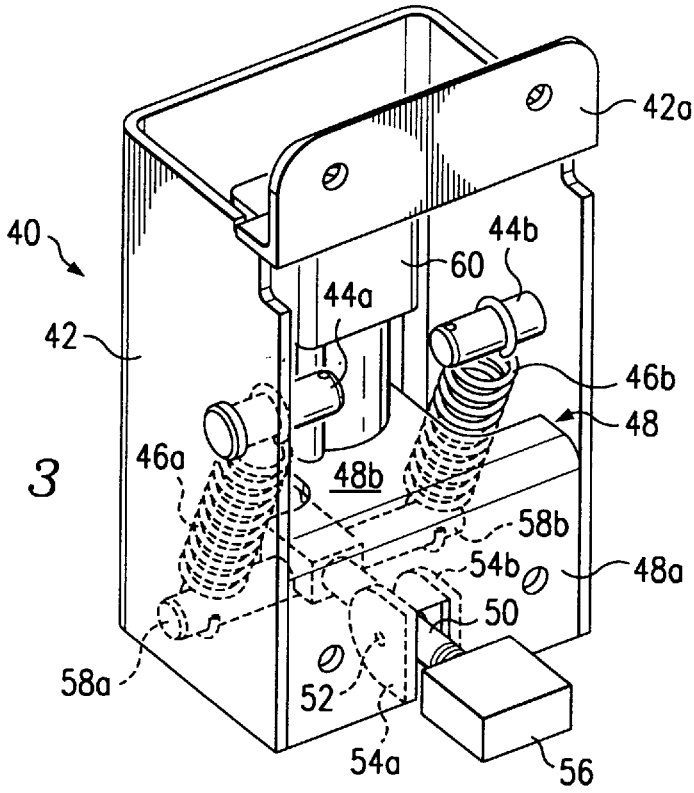
FIG. 3 is an enlarged isometric view of one of the clamping devices of FIGS. 1 and 2.
Figure 5:
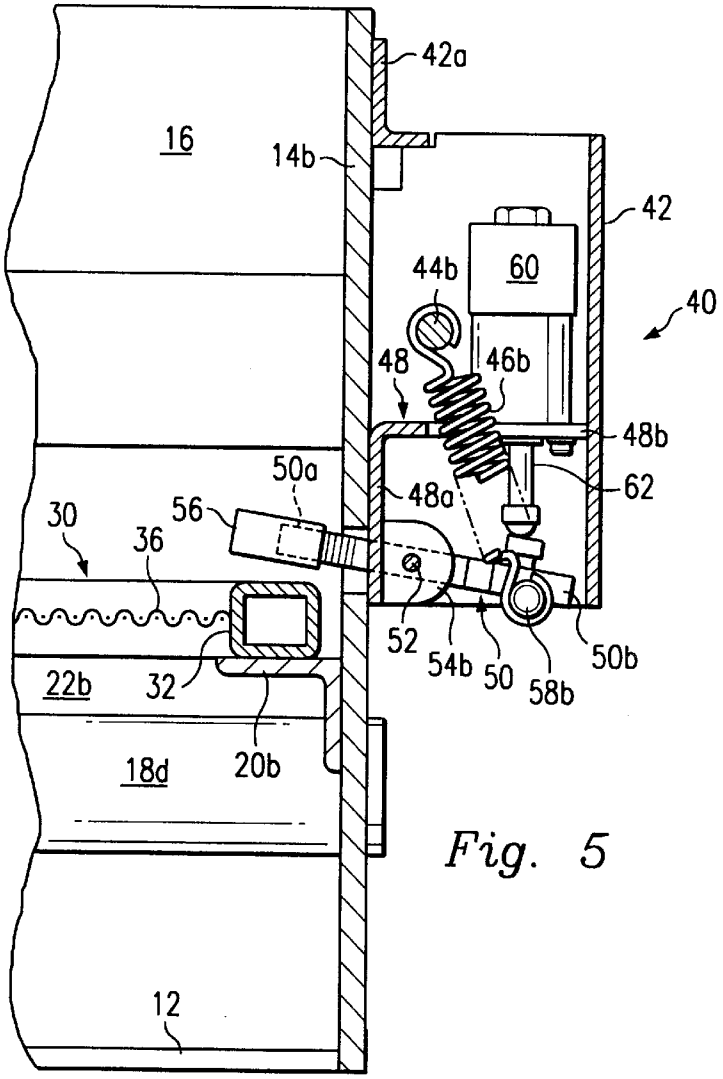
FIG. 5 is a view similar to that of FIG. 4 but depicting the clamping device of FIG. 4 in a different operating mode.
Figure 4:
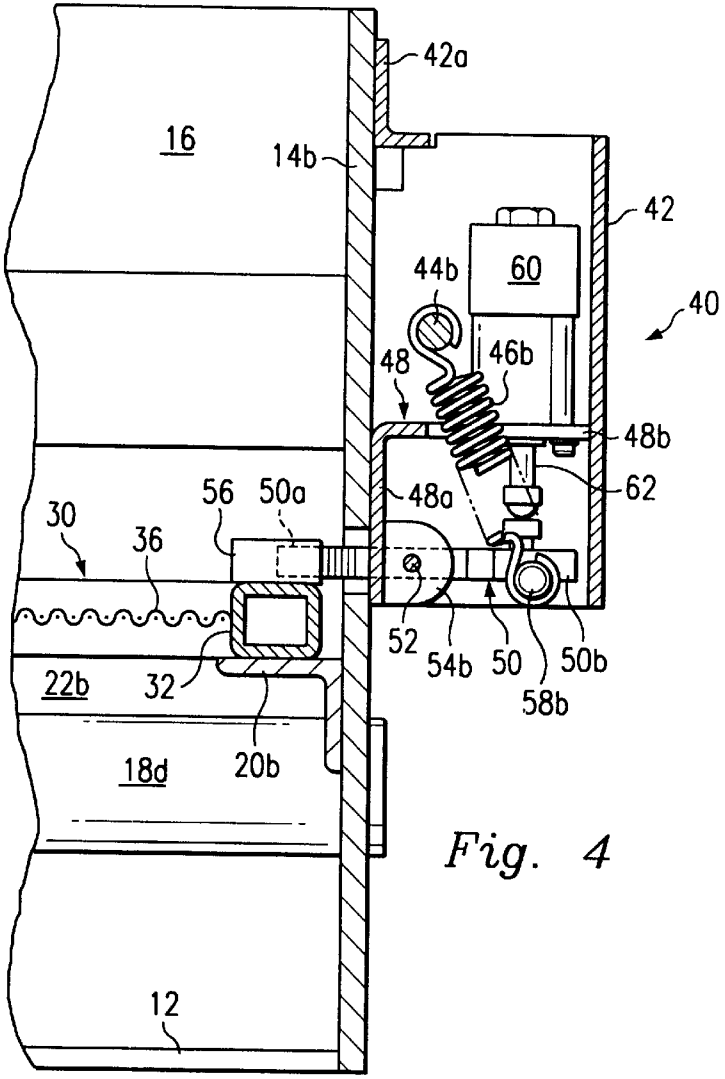
FIGS. 4 is an enlarged sectional view taken along the line 4—4 of FIG. 1.

One of the clamping devices 40 is shown in detail in FIGS. 3–5 and includes a substantially U-shaped elongated housing 42 having a mounting flange 42*a* extending from the upper end thereof for bolting to the outer surface of the side wall 14*b*. Two posts 44*a* and 44*b* through openings in the respective side walls of the housing 42 with one end portion of each projecting out from its corresponding side wall. The corresponding ends of two compression springs 46*a* and 46*b* are attached to the projecting portions of the posts 44*a* and 44*b*, respectively.

As better shown in FIGS. 4 and 5, a L-shaped support bracket 48 is disposed in the housing and includes a first, vertically extending leg 48*a* which extends across the lower rear portion of the housing, and a horizontally extending leg 48*b*. Two openings (FIG. 3) are provided through the leg 48*a* for receiving bolts, or the like to mount the bracket 48 to the side wall 14*b*.

A clamping lever arm 50 is pivotally mounted in the housing 42 about a fixed pin 52 mounted between two devises 54*a* and 54*b* (FIG. 3) extending from the leg 48*a* of the bracket 48. The arm 50 extends through an opening in the leg 48*a* of the bracket 48, and through an opening in the side wall 14*b*.

A clamping pad 56 is mounted on the end portion 50*a* of the arm 50 extending inside the side wall 14*b*. The other end portion 50*b* of the arm 50 extends in the housing 42 and two posts 58*a* and 58*b* (FIG. 3) extend from opposite sides, respectively, of the latter end portion and receive the other ends of the springs 46*a* and 46*b*, respectively. The springs 46*a* and 46*b* thus pull the end portion 50*b* of the arm 50 upwardly as viewed in the drawings and, due to the pivotal mounting of the arm about the pin 52, urge the end 50*a* of the arm, and therefore the pad 56, downwardly and towards the angle iron 20*b*. Since a side wall portion of the frame 32 of the screen assembly 30 rests on the angle iron 20*b* the pad 56 is thus urged into a clamping engagement with the latter frame portion.

An actuator, in the form of an air cylinder 60, is mounted on the leg 48*b* of the bracket 48, and has a movable plunger 62 that projects from the bottom of the cylinder and through an opening in the leg. The plunger 62 is adapted to extend in an axial direction in response to the flow of air from an external source (not shown) into the cylinder 60, and is adapted to retract, under a spring force, or the like, when the air flow is terminated. Since the air cylinder 60 is conventional, it will not be described in any further detail.

In the retracted position of the plunger shown in FIG. 4, the springs 46*a* and 46*b* urge the pad 56 onto the corresponding upper surface of the frame 32 of the screen assembly 30 to clamp the frame between the pad and the angle iron 20*b*. When it is desired to remove the screen assembly 30 for cleaning or replacement, the air cylinder 60 is actuated to extend the plunder 62 into engagement with the end portion 50*b* of the arm 50 with a force sufficient to overcome the force of the springs 46*a* and 46*b*. Thus, the end portion 50*b* is pushed downwardly, and the pad 56 is pivoted away from the frame 32 to the position shown in FIG. 5 to release the clamping engagement with the frame.

It is understood that the other clamping device 40 that is mounted on the sidewall 14*b*, the other two clamping devices 41 mounted on the side wall 14*b*, and the corresponding clamping devices mounted on the side wall 14*a*, all function in an identical manner. Thus, the screen assembly 30 can easily and quickly be clamped to and released from the angle irons 20*a* and 20*b* by the clamping devices 40, and the screen assembly 38 can easily and quickly be clamped to and released from the angle irons 24*a* and 24*b* by the clamping devices 41.

The present invention thus enjoys several advantages. For example, the clamping devices on both side walls of the bed securely clamp corresponding portions of the respective frames of the screen assemblies in the operative position of the screen assemblies, yet permit quick and easy disengagement of the clamping force. Also, each screen assembly is positively clamped in place by spring tension regardless of air pressure availability, while a pneumatic diaphragm cylinder is used to provide a quick and positive release. Further, the clamping devices are easily accessible and can be replaced on an individual basis as needed. Further, the system and method of the present invention features quick, external access and single component replacement instead of requiring complete screen unit disassembly.

It is understood that several variations may be made in the foregoing without departing from the scope of the invention. For example, the number of screens, angle irons, and clamping devices can be varied within the scope of the invention. Also, the clamping devices can be used in other applications, such as manufacturing processes, molding and welding fabrication. Further, the actuator can take other forms other than an air cylinder.

It is understood that other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A clamping device for clamping an object to a structure, the device comprising a lever arm pivotally mounted relative to the structure, two springs extending to either side of the arm and connected to one end portion of the arm to apply a spring force to the one end portion in a direction to pivot the other end portion into engagement with the object, and an actuator supported by the housing and adapted to engage the one end portion of the arm to pivot the other end portion out of the engagement.

2. A separator comprising a bed comprising at least one wall; a screen supported in the bed; and a device for clamping the screen to the bed, the device comprising a lever arm pivotally mounted relative to the wall, two springs extending to either side of the arm and connected to one end portion of the arm to apply a spring force to the one end portion in a direction to pivot the other end portion into engagement with the screen, and an actuator supported by the housing and adapted to engage the one end portion of the arm to pivot the other end portion out of the engagement.

3. The separator of claim 2 wherein the bed is vibrated to separate materials introduced to the screen.

4. A separator comprising a bed comprising at least one wall; a screen supported in the bed; and a device for clamping the screen to the bed, the device comprising a lever arm pivotally mounted relative to the wall, two springs extending to either side of the arm and connected to the one end portion of the arm to apply a spring force to the latter end portion to urge the one end portion of the arm in a direction to pivot the other end portion of the arm into clamping engagement with the screen; and an actuator supported by the housing and adapted to engage the one end portion of the arm to pivot the other end portion out of the clamping engagement.

5. The separator of claim 4 wherein the actuator comprises a plunger normally in a retracted position and adapted to move to its extended position with a force that exceeds the spring force to engage the one end portion and pivot the other end portion of the arm out of the engagement with the screen.

6. The separator of claim 5 wherein the actuator is an air cylinder and is actuated by introducing air into the cylinder to move the plunger to its extended position.

7. The separator of claim 5 wherein the plunger is adapted to retract so that the urging member causes the other end portion of the arm to move towards the screen.

8. The separator of claim 4 further comprising a housing mounted on the outer surface of the wall, and a pivot pin mounted to the housing, the arm being pivotally mounted to the pin with the other end portion extending from the housing and through the wall and with the one end portion disposed in the housing.

9. The separator of claim 4 further comprising a pad mounted on the other end portion for engaging the screen.

10. The separator of claim 4 wherein the bed comprises two opposed walls, and further comprising two support members connected to the inner surfaces of the walls, respectively, for receiving the screen, the one end of the arm clamping the screen against one of the support members.

11. A clamping device for clamping an object to a structure, the device comprising a lever arm pivotally mounted relative to the structure, two compression springs extending to either side of the arm and connected to the one end portion of the arm to apply a spring force to the latter end portion to urge the other end portion of the arm into clamping engagement with the object, and an actuator supported by the housing and adapted to engage the one end portion of the arm to pivot the other end portion out of the clamping engagement.

12. The device of claim 11 wherein the actuator comprises a plunger normally in a retracted position and adapted to move to its extended position with a force that exceeds the spring force to engage the one end portion and pivot the other end portion of the arm out of the engagement with the object.

13. The device of claim 12 wherein the actuator is an air cylinder and is actuated by introducing air into the cylinder to move the plunger to its extended position.

14. The device of claim 12 wherein the plunger is adapted to retract so that the urging member causes the other end portion of the arm to move towards the object.

15. The device of claim 11 further comprising a housing mounted on the outer surface of the structure, and a pivot pin mounted to the housing, the arm being pivotally mounted to the pin with the other end portion extending from the housing and through the structure and with the one end portion disposed in the housing.

16. The device of claim 11 further comprising a pad mounted on the end portion for engaging the object.

17. The device of claim 11 wherein the structure comprises two opposed walls, and further comprising two support members connected to the inner surfaces of the walls, respectively, for receiving the object, the one end of the arm clamping the object against one of the support members.

18. A separator comprising a bed comprising at least one wall having an opening; a screen unit supported in the bed and extending within the wall; an arm extending through the opening in the wall and pivotally mounted relative to the wall, the arm having one end portion extending within the wall and adjacent the screen unit, and another end portion located outside of the wall; force-applying apparatus for applying a predetermined force to the other end portion in a direction to pivot the arm so that the one end portion engages the screen unit with a force proportional to the predetermined force; and an actuator adapted to selectively apply a force to the other end portion in excess of the predetermined force to pivot the arm so that the one end portion moves out of the engagement.

19. The separator of claim 18 wherein the force-applying apparatus is in the form of at least one spring connected to the other end portion.

20. The separator of claim 18 wherein the force-applying apparatus is in the form of at least two springs connected to the either side of the other end portion.

21. The separator of claim 18 wherein the actuator comprises a plunger normally in a retracted position and adapted to move to its extended position to apply the excessive force in a direction opposite the direction of the force applied by the force-applying apparatus.

22. The separator of claim 21 wherein the actuator is an air cylinder and is actuated by introducing air into the cylinder to move the plunger to its extended position.

23. The separator of claim 22 wherein the plunger is adapted to retract so that the force applying apparatus causes the one end portion to move into engagement with the screen unit.

24. The separator of claim 18 further comprising a housing mounted on the outer surface of the wall, and a pivot pin mounted to the housing, the arm being pivotally mounted to the pin.

25. The separator of claim 18 further comprising a pad mounted on the one end portion for engaging the screen unit.

26. The separator of claim 18 wherein the bed comprises two opposed walls, and further comprising two support members connected to the inner surfaces of the walls, respectively, for receiving the screen unit, the one end portion clamping the screen unit against one of the support members.

27. The separator of claim 26 wherein the one end portion is forced generally downwardly into engagement with the screen unit.

28. The separator of claim 18 wherein the screen unit comprises a frame and a screening member supported by the frame, the one end portion engaging the frame.

29. A method of clamping a screen relative to a bed in a separator, the method comprising providing an arm extending through an opening in a wall of the separator; pivotally mounting the arm relative to the wall; the arm having one end portion disposed adjacent the screen within the wall, and another end portion located outside of the wall; applying a predetermined force to the other end portion in a direction to pivot the arm so that the one end portion engages the screen with a force in proportional to the predetermined force; and selectively applying a force to the other end portion in excess of the predetermined force to pivot the arm so that the one end portion moves out of the engagement.

30. The method of claim 29 further comprising the step of discontinuing the application of the excessive force, whereby the one end portion moves into engagement with the screen unit.

31. The method of claim 29 wherein the one end portion is forced generally downwardly into engagement with the screen.

* * * * *